US005253507A

United States Patent [19]

Lycan

[11] Patent Number: 5,253,507

[45] Date of Patent: Oct. 19, 1993

[54] METHOD OF FORMING A SPACER USED TO SPACE END TO END PIPING

[75] Inventor: Goodwin A. Lycan, Stevensville, Mich.

[73] Assignee: G.A.L. Gage Co., Stevensville, Mich.

[21] Appl. No.: 912,266

[22] Filed: Jul. 13, 1992

[51] Int. Cl.[5] ..... B21F 37/00

[52] U.S. Cl. ..... 72/414; 72/385; 140/88; 29/173; 29/890.14; 29/888.073; 227/143

[58] Field of Search ..... 72/414, 415, 385; 140/88; 29/888.073, 888.071, 888.07, 173, 890.14; 227/138, 141-143, 216

[56] References Cited

U.S. PATENT DOCUMENTS

| | | | |
|---|---|---|---|
| 1,668,297 | 5/1928 | Wuerfel | 29/173 |
| 1,689,608 | 10/1928 | Williams | 29/888.073 |
| 2,854,301 | 9/1958 | Lutz | 29/888.07 |
| 3,748,889 | 7/1973 | Miller | 72/385 |

FOREIGN PATENT DOCUMENTS

| | | | |
|---|---|---|---|
| 128338 | 10/1980 | Japan | 72/414 |
| 902910 | 2/1982 | U.S.S.R. | 72/385 |

*Primary Examiner*—Daniel C. Crane

*Attorney, Agent, or Firm*—James D. Hall; Thomas J. Dodd

[57] ABSTRACT

A method of forming undulate protrusions on a split ring with the ring placed in a die to first form a center protrusion and then to form the other protrusions located between the first formed protrusion and the ring ends.

3 Claims, 4 Drawing Sheets

METHOD OF FORMING A SPACER USED TO SPACE END TO END PIPING

BACKGROUND OF THE INVENTION

This invention relates to a method of forming a spacer used to separate end to end piping which are to be welded together.

A problem prevalent in welding is maintaining the separation of a pipe and the internal shoulder of the fitting to which the pipe is to be welded. The spacer of this invention is of similar construction and function of that spacer in U.S. Pat. No. 4,346,918 granted Aug. 31, 1982. Many industries that utilize the spacer require it to pass a stress corrosion cracking resistance test. This ASTM. G36-87 test involves immersing the spacer in a 42% boiling magnesium chloride solution that accelerates destructive forces to simulate long term usage of the spacer. On all previous occasions when this test has been conducted on a spacer in which all the protrusions were formed at one time, hairline cracks were noticed at the base of the center protrusion after seven days of exposure to the solution, definite evidence of cracking at the base of the center protrusion was noticed after fourteen days of exposure and the spacer actually broke at the base of the center protrusion after twenty-one days of exposure.

To alleviate this stress inherent in the spacer due to cold forming, the present method forms the rear or center protrusion of the spacer first allowing stresses from this rear hump to escape or be relieved through the split in the ring. Then, the remaining protrusions of the spacer are formed. This minimizes the compressive stress within the spacer between protrusions. For example, when the test utilizing the magnesium chloride solution is performed on this spacer, no evidence of discoloration, cracking, or deterioration of the rings was revealed after twenty-eight days of exposure to the solution.

SUMMARY OF THE INVENTION

The forming of the spacer begins with a round wire which is wound around a mandrel to form a circle. A segment is cut from the wire to form a split with the spacer ends being separated from each other. The spacer is then inserted between a male and a female die parts to form the center protrusion. Therefore, the spacer is placed in the die to form the remaining protrusions.

Hence, it is an object of this invention to form a spacer which has separated protrusions and which will not fracture between protrusions during long term use.

It is another object of this invention to form a spacer which has separated protrusions and can withstand the stress corrosion cracking resistance test.

Other objects will become apparent upon a reading of the following description.

BRIEF DESCRIPTION OF THE DRAWINGS

A preferred embodiment of the invention has been depicted for illustrative purposes only wherein.

DESCRIPTION OF THE PREFERRED EMBODIMENT

The preferred embodiment herein described is not intended to be exhaustive or to limit the invention to the precise form disclosed. It is chosen and described to explain the principles of the invention and its application and practical use to enable others skilled in the art to follow its teachings.

Figure 5:
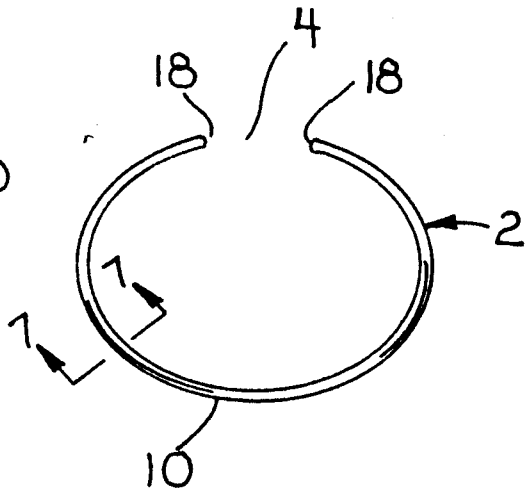
FIG. 5 is a perspective view showing the spacer in its round ring form before it is placed in the dies.
Figure 7:
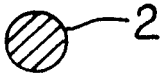
FIG. 7 is a sectional view taken along line 7—7 of FIG. 5.

Referring to FIGS. 5 and 7, a wire ring 2 is formed from a round MIG stainless steel welding wire 10. The wire is first wound around a cylindrical mandrel (not shown) having a diameter substantially equal to the desired diameter of the completed spacer. The wire is then clipped or cut to remove a section or segment to form an enlarged split 4 between spaced ends 18 of the ring 2, as shown in FIG. 5.

Figure 1:
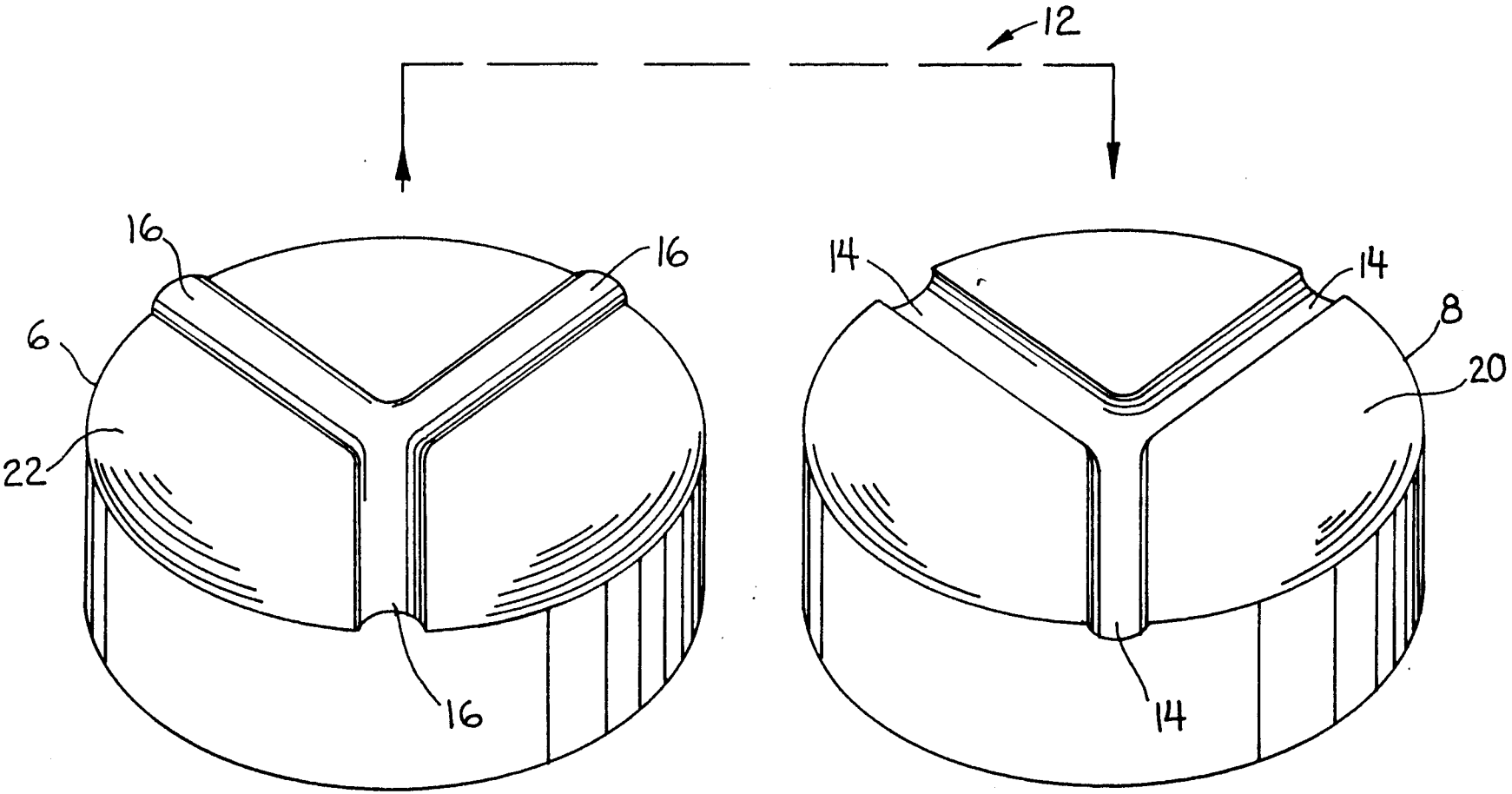
FIG. 1 shows a perspective view of the male die and the female die used to form the spacer.
Figure 2:
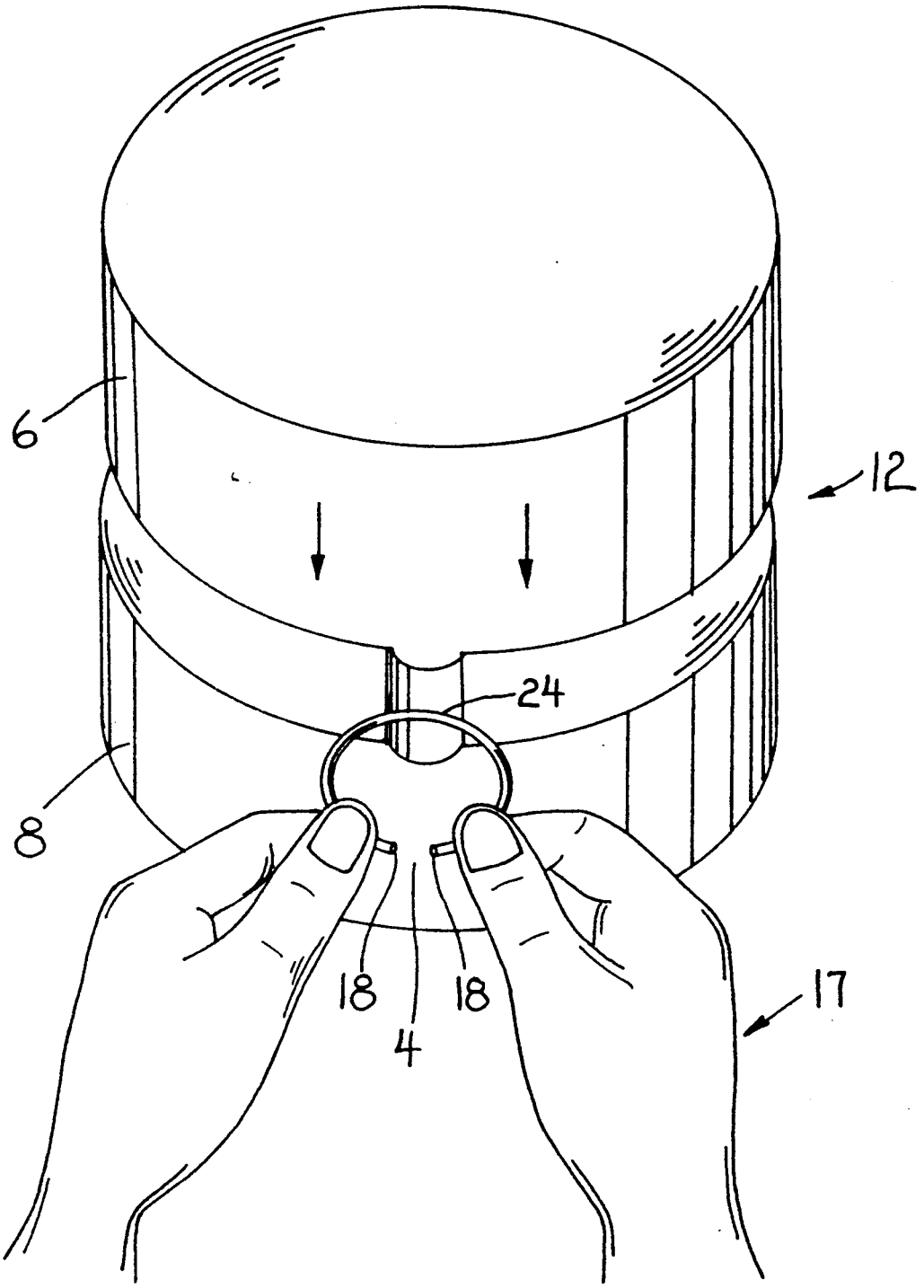
FIG. 2 is a top perspective view showing the spacer placed on the edge of the female die to form the rear protrusion.

The ring 2 is then initially placed in a stamping die 12 by a worker 17 as shown in FIG. 2. The die 12 has a cylindrical male part 6 and a cylindrical female part 8 as depicted in FIG. 1. The female part 8 has three equal angularly spaced elongated grooves 14, generally U-shaped in cross section, formed on its top surface 20. Each groove 14 extends radially from the center of the female part 8 to its outer edge. The male part 6 has three equal angularly spaced elongated lands 16 which are generally of an inverted U-shape in cross section formed on its bottom surface 22. Each land 16 extends radially from the center of the male part 6 to its outer edge. The lands 16 and grooves 14 interfit when the die parts are urged together as illustrated by the arrows in FIGS. 2 and 3.

Figure 3:
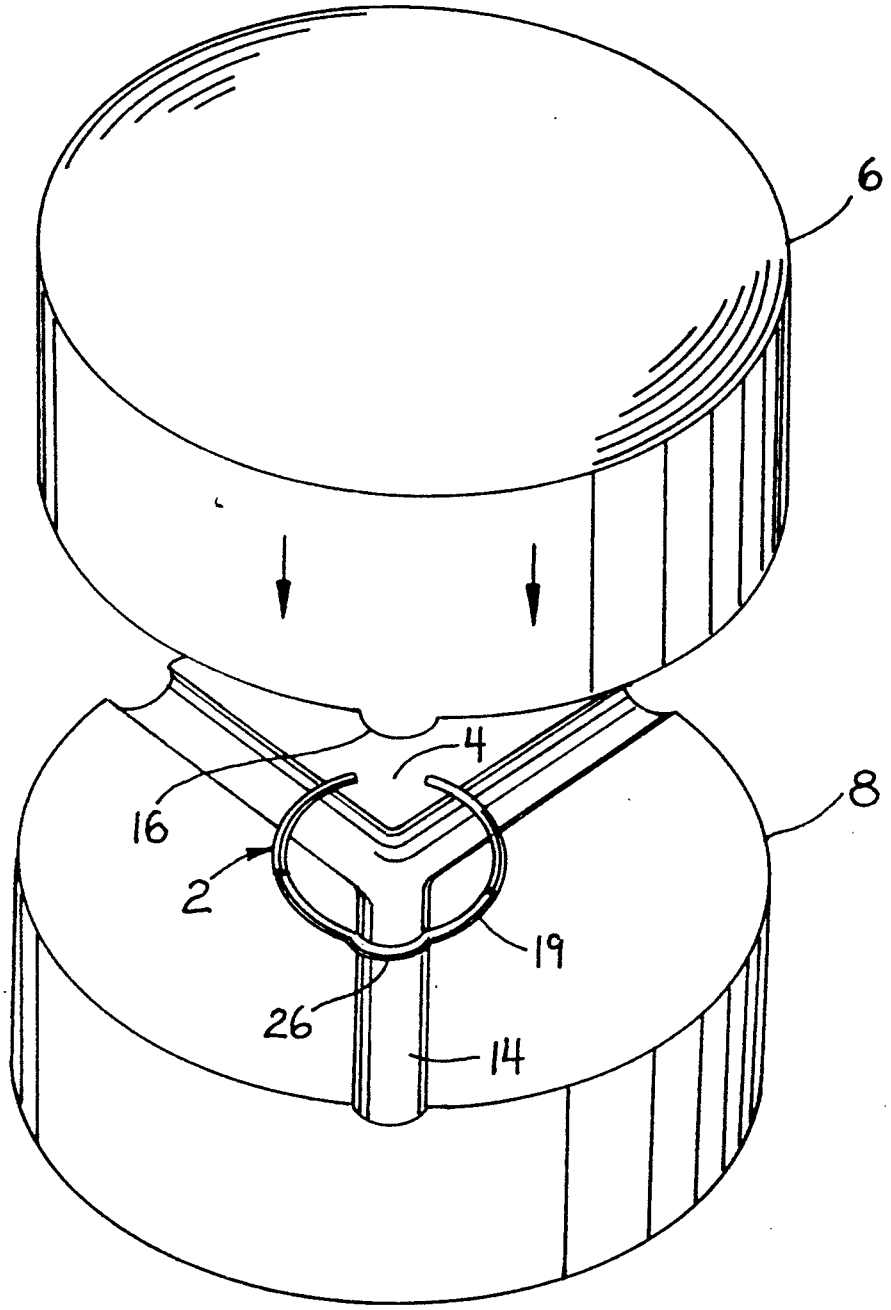
FIG. 3 is a top perspective view showing the spacer placed into the center of the female die to form the remaining protrusions.
Figure 4:
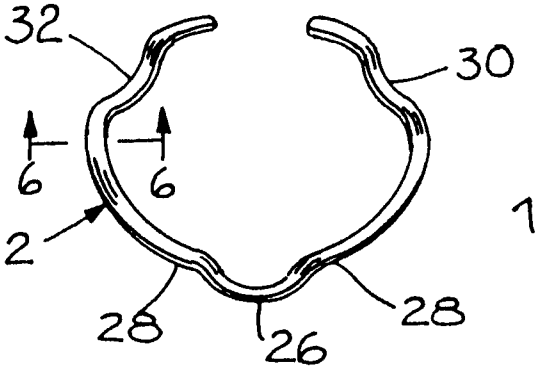
FIG. 4 is a perspective view showing the spacer in completed form.
Figure 6:
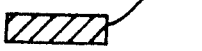
FIG. 6 is a sectional view taken along line 6—6 of FIG. 6.

Ring 2 is first positioned at its center portion between the female and male parts of the die 12 such that the arc or edge 24 opposite from the split 25 of the spacer is centered over a groove 14 of the female die as seen in FIG. 2. The die parts are then pressed together forming the center undulate protrusion 26 of the spacer and also flattening the center portion of the spacer. The male die part 6 is then moved away from the female die part 8. The ring is then rotated 180° and centered in the middle of the female die part with protrusion 26 fitted into a groove 14 as shown in FIG. 3. The parts of the die are then pressed together flattening the remainder of the ring and forming the remaining two undulate protrusions 30 and 32 shown in FIG. 4.

Previously, when protrusions 26, 30 and 32 were formed at one time in the die, by cold forming, the stresses in the flattened spacer portions between protrusions at the center protrusion 26 were locked in by protrusions 30 and 32 at the center protrusions and were subject to fracture. In the present invention by forming the center protrusions first, the stress within the spacer at the center protrusion is significantly relieved.

The above description is not to be considered as limiting the invention to those details above-given, which may be modified within the scope of the following claims.

I claim:

1. A method of forming an annular split ring pipe spacer having a plurality of undulate protrusions thereon comprising the steps of:

a) providing a split ring of wire having spaced ends;

b) first compressing said ring at a center portion of the ring to form one of said protrusions in the ring generally equally spaced from its sized ends; and c) thereafter compressing said ring spacedly between said first formed protrusion and each of said ring ends to form another of said protrusions between and separated spacedly from the first formed protrusion and each ring end.

2. A method of forming an annular split ring pipe spacer having a plurality of undulate protrusions thereon comprising the steps of:

a) providing a stamping die having a male part and a female part, said female part having a plurality of grooves, said male part having a plurality of lands interfitting with said grooves when said die parts are pressed together for use, with said lands and said grooves opposingly aligned with each other;

b) providing a split ring of wire having spaced ends;

c) first placing a center portion of said ring between one of said lands of said die male part and a said opposing groove of said female die part;

d) pressing said die parts together to form one of said protrusions in the ring generally equally spaced from its said ends;

e) thereafter placing said ring between said die parts with each portion of said ring between said one protrusion and a said ring end located between a said land and a said opposing groove of the die parts; and f) pressing said die parts of said die together to form another of said protrusions between the first formed protrusions and each ring end.

3. The method of claim 1 wherein step (c) includes in the formation of each of said other protrusions an elongated flattened portion of said ring extending between said first formed protrusion and each other said protrusion.

* * * * *